US005595199A

United States Patent [19]

Solomon et al.

[11] Patent Number: 5,595,199

[45] Date of Patent: Jan. 21, 1997

[54] HAIR CONTAINER

[76] Inventors: Charleen Solomon, 1302 Antrim Dr.; Karin Copeland, 1303 Antrim Dr., both of Roseville, Calif. 95747

[21] Appl. No.: 380,130

[22] Filed: Jan. 30, 1995

[51] Int. Cl.[6] ..... A45D 8/04; A45D 8/34; A45D 8/36

[52] U.S. Cl. ..... 132/273; 132/277; 132/274; 132/276

[58] Field of Search ..... 54/78; 132/210, 132/273, 274, 278, 279; 2/195.1, 195.2, 195.3, 200.1, 171, 174, 207

[56] References Cited

U.S. PATENT DOCUMENTS

| | | | |
|---|---|---|---|
| 127,918 | 6/1872 | Parson et al. | 54/78 |
| 154,737 | 9/1874 | Wellington . | |
| 2,028,714 | 7/1936 | Burwick | 150/11 |
| 2,152,894 | 4/1939 | Langlois | 132/1 |
| 2,475,320 | 7/1949 | Herschensohn | 132/49 |
| 2,487,005 | 11/1949 | Walker | 54/78 |
| 2,508,631 | 5/1950 | Woodside | 132/49 |
| 2,884,645 | 5/1959 | Berg | 132/274 |
| 3,543,770 | 12/1970 | Snider | 132/7 |
| 3,692,032 | 9/1972 | Regas | 132/9 |
| 3,726,289 | 4/1973 | Thompson | 132/9 |
| 3,746,016 | 7/1973 | Goodman | 132/46 R |
| 3,861,405 | 1/1975 | Pellecchia | 132/9 |
| 4,378,667 | 4/1983 | Velarde | 54/78 |
| 5,170,808 | 12/1992 | Vild | 132/210 |
| 5,235,709 | 8/1993 | Terlep | 4/515 |

*Primary Examiner*—John G. Weiss
*Assistant Examiner*—Pedro Philogene
*Attorney, Agent, or Firm*—Bielen, Peterson & Lampe

[57] ABSTRACT

A hair container utilizing a sheath for enclosing strands of hair which extend into the sheath. The sheath includes a flexible wall portion which forms a chamber having an opening to the same in order to permit the strands of hair to extend into the sheath. A clamp is connected to the flexible wall portion of the sheath and is capable of holding the strands of hair to prevent relative movement between the flexible wall portion of the sheath and the strands of hair. The sheath itself is drawn around the strands of hair by a drawstring formed in the sheath flexible wall portion.

10 Claims, 1 Drawing Sheet

HAIR CONTAINER

BACKGROUND OF THE INVENTION

The present invention relates to a novel and useful hair container.

Hair nets and snoods have been devised to hold hair appending from the head of a person. In many cases, nets or snoods are employed to protect hair from the elements such as the sun which generally prevents bleaching and damage to the very ends of the strands of hair. Many devices have been employed in conjunction with hair treatment solutions for grooming purposes. For example, U.S. Pat. Nos. 3,543,770 and 3,726,289 describe confining devices which utilize clips or bags.

U.S. Pat. Nos. 5,170,808 and 5,235,709 describe permanent wave bags which employ head covering portions that are saturated with chemical treatments.

U.S. Pat. Nos. 2,152,894; 2,475,320; 2,508,631; and 3,746,016 teach hair nets which employ ties, clips, or elastic bands to hold the same to a portion or all of the hair of the user.

U.S. Pat. Nos. 3,692,032 and 3,861,405 show hair dressing appliances that employ clamps in conjunction with attached flaps to confine hair into a certain position during treatment with hair dressing materials.

U.S. Pat. Nos. 154,737 and 2,028,714 show bags having clamp-like fasteners.

Nets or snoods for holding or protecting hair have disadvantages in that they tend to slip and require constant re-adjustment on the hair of the user.

A hair container which overcomes such disadvantages found in the prior art would be a notable advance in the fashion and hair covering field.

SUMMARY OF THE INVENTION

In accordance with the present invention a novel and useful hair container is herein provided.

The hair container of the present invention utilizes a sheath for enclosing strands of hair extending from the head of a user. The strands of hair extend into the sheath which is formed from a flexible wall portion. The sheath includes a chamber and an opening to the same to permit the strands of hair to extend into the chamber of the sheath.

A clamp is also found in the present invention and is connected to the flexible wall portion forming the sheath. The clamp is placed within the chamber of the sheath and is capable of tightly holding the strands of hair which extend into the chamber of the sheath. Thus, relative movement between the flexible wall portion of the sheath and the strands of hair is prevented by the clamp. The clamp may take the form of a base fastened to the flexible wall portion of the sheath and a bar which rotatably connected to the base. A latch locks the rotation of the bar relative to the base. The base member may be riveted, sewed, glued, or otherwise firmly fixed to the flexible wall portion of the sheath.

Holding means is also found in the present invention for drawing the flexible wall portion of the sheath against the strands of hair which is held by the clamp within the chamber of the sheath. Such holding means may be constructed as a drawstring which is sewn into the mouth of the opening portion of the chamber of the sheath, an elastic band found in the same area, and the like. Such holding means draws the strands of hair together and aids in the holding of the hair by the clamp fixed to the fixable wall portion of the sheath.

Moreover, a flange may be fastened to the opening portion of the chamber of the sheath and extend upwardly to further protect the hair or to provide a decorative feature. Moreover, indicia or designs may be placed on an outer surface of the flange for this purpose.

It may be apparent that a novel and useful hair container has been described.

It is therefore an object of the present invention to provide a hair container which quickly and easily confines strands of hair to a protective sheath.

Another object of the present invention is to provide a hair container which protects strands of hair from damaging elements such as sun, moisture, and the like.

Another object of the present invention is to provide a hair container which includes a sheath that is held firmly to strands of hair and is protected against movement relative to the strands of hair.

Another object of the present invention is to provide a hair container which protects strands of hair and provides a decorative fashion statement at the same time.

The invention possesses other objects and advantages especially as concerns particular characteristics and features thereof which will become apparent as the specification continues.

Figure 2:
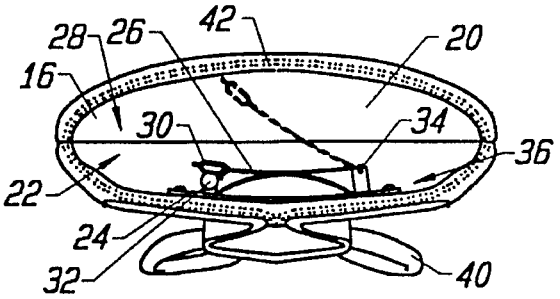
FIG. 2 is a top plan view of the hair container of the present invention.

For a better understanding of the invention references made to the following detailed description of the preferred embodiments thereof which should be referenced to the prior described drawings.

DETAILED DESCRIPTION OF THE PREFERRED EMBODIMENTS

Various aspects of the present invention will evolve from the following detail description of the preferred embodiments thereof which should be taken in conjunction with the prior described drawings.

The invention as a whole is shown in the drawings by reference character 10. Hair container 10 includes as one of its elements a sheath 12 which may be formed of a suitable material that possesses flexibility. In this regard, sheath 12 includes a wall portion 14 which is composed of flexible material such as cloth, leather, plastic, and the like. Wall portion 14 possess an opening or mouth 16 and a bottom portion 18 forming a chamber 20 within sheath 12.

Container 12 possesses as one of its elements a clamp 22 which is fastened to flexible wall portion 14 of sheath 12 and within chamber 20 thereof. Clamp 22 is depicted in the embodiment shown in FIG. 2 as having a base portion 24 and a rotatable bar 26. It should be noted that bar 26 is depicted in phantom in its open position and in solid line in its closed position on FIG. 2. Locking means 28 holds bar 26 to base member 24 by the interaction of loop 30 and hook 32. Such locking means is known in the art and formed the portion of a barrette of conventional configuration. Thus, clamp 22 may take the form of a 2½ inch French Barrette manufactured by Sta-Rite of Newark, N.J. Bar 26 is attached to base portion 24 at pivot pin 34. Sew lines 36 at either end of base portion 24 hold clamp 22 to flexible wall portion 14. In addition, glue, rivets, or other fastening means may be employed in this regard.

Sheath 12 is also formed with holding means 38 for drawing wall portion 14 together. Holding means 38 takes the form of a line or ribbon 40 which extends about the upper closed rim 42 forming opening or mouth 16 to chamber 20 of sheath 12. Aperture 44, FIG. 2, permits the ends 46 and 48 of line 40 to exit cavity 47 formed at the rim 42 of sheath 12. Thus, ends 46 and 48 of line 40 may be cinched or tied to draw rim 42 into a tight configuration.

The container of the present invention may also possess a flange 49 shown in the drawings as a pleated member 50. Pleated member 50 is sewn to the interior of flexible wall portion 14 and extends upwardly. Surface 52 of pleated member 50 may be employed to display a design, indicia, or the like.

Figure 4:
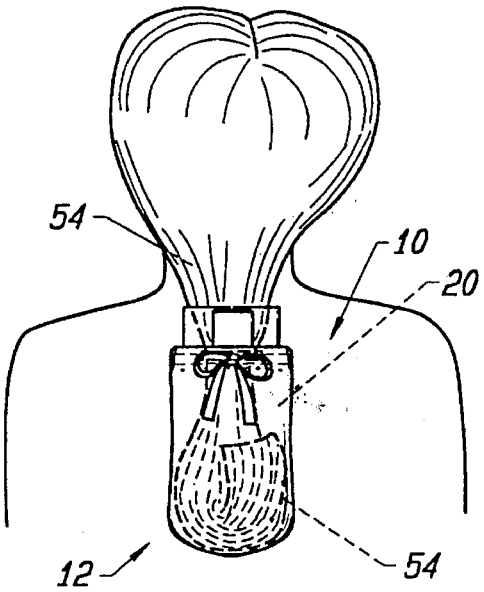
FIG. 4 is a rear view of a user of the hair container of the present invention depicting hair within the sheath of the hair container in phantom.
Figure 1:
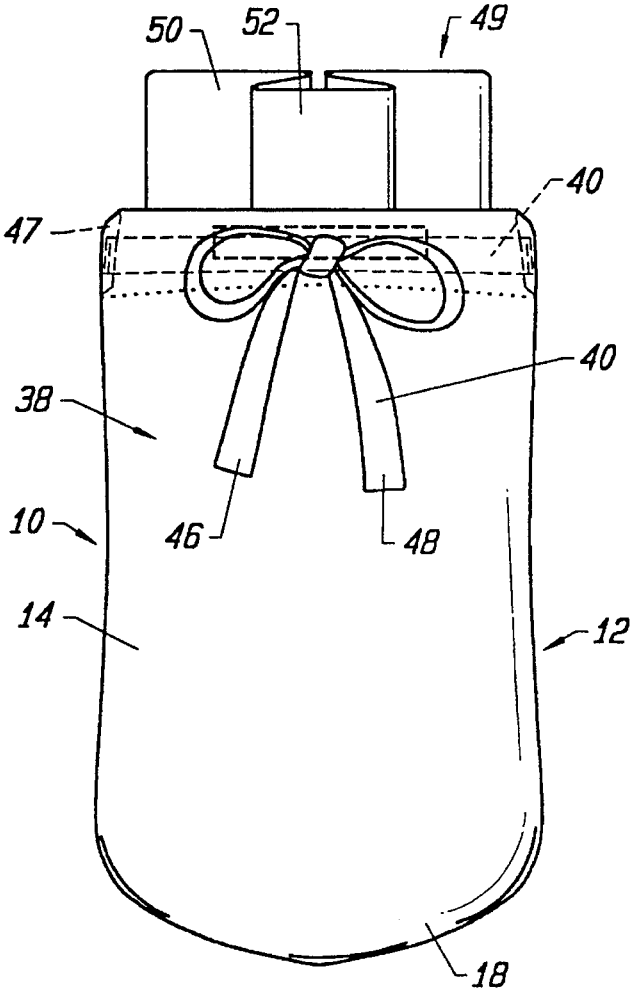
FIG. 1 is a front elevational view of the hair container of the present invention.
Figure 3:
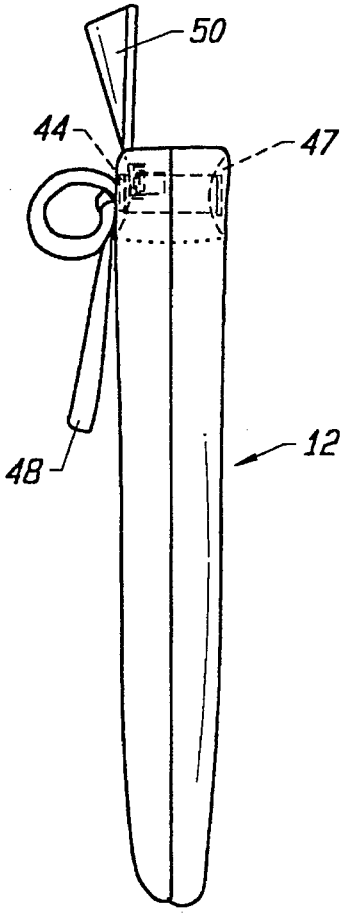
FIG. 3 is a right side elevational view of the hair container of the present invention.

In operation, FIG. 4 depicts container 10 in place with strands of hair 54 extending into chamber 20 of sheath 12. Clamp 22, in the form of a barrette attached to flexible wall portion 14 firmly grasps strands of hair 54 within chamber 20 of sheath 14. Holding means 38 may then be employed to cinch the rim portion 42 of sheath 12 around strands of hair 54. As depicted in FIGS. 1–3, line 40 is tied into a bow. Holding means 38 prevents the pealing down or drooping of rim 42 of sheath 12 during use of container 10. Pleated member 50 extends upwardly along strands of hair 54 for the purpose of design and to further protect strands of hair 54 from destructive elements such as sun, moisture, and the like.

While, in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A hair container, comprising:

a. a sheath for enclosing strands of hair extending into said sheath, said sheath including a flexible wall portion forming a chamber and an opening to said chamber to permit the strands of hair to extend into said sheath;

b. a clamp mounted to said flexible wall portion of said sheath within said chamber of said sheath, said clamp being capable of engaging and holding the strands of hair to prevent relative movement between said flexible wall portion within said chamber of said sheath and the strands of hair extending into said chamber of said sheath; and c. holding means for drawing said flexible wall portion of said sheath against the strands of hair.

2. The container of claim 1 in which said clamp includes a base, a bar rotatable relative to said base, and a latch to lock said rotation of said bar relative to said base.

3. The container of claim 2 in which said base is connected to said flexible wall portion of said sheath, adjacent said opening to said sheath chamber.

4. The container of claim 1 in which said holding means includes a line capable of extending about said flexible wall portion of said bag and being cinched against said flexible wall portion of said bag.

5. The container of claim 4 in which said sheath additionally comprises an aperture formed by said flexible wall portion thereof, said line being sized to pass through said aperture.

6. The container of claim 4 in which said clamp includes a base, a bar rotatable relative to said base, and a latch to lock said rotation of said bar relative to said base.

7. The container of claim 6 in which said base is connected to said flexible wall portion of said sheath, adjacent said opening to said sheath chamber.

8. The hair container of claim 1 which additionally comprises a flange extending outwardly from said flexible wall portion of said sheath adjacent said opening to said chamber.

9. The hair container of claim 8 in which said clamp includes a base, a bar rotatable relative to said base, and a latch to lock said rotation of said bar relative to said base.

10. The hair container of claim 9 in which said base is connected to said flexible wall portion of said sheath, adjacent said opening to said sheath chamber.

* * * * *